United States Patent [19]

Mills

[11] 4,406,188

[45] Sep. 27, 1983

[54] NUT-HOLDER ATTACHMENT FOR OPEN-END WRENCH

[76] Inventor: Blaine N. Mills, 2020 Todd Way, Taylorsville, Utah 84119

[21] Appl. No.: 322,750

[22] Filed: Nov. 19, 1981

[51] Int. Cl.[3] ..... B25B 23/10

[52] U.S. Cl. ..... 81/180 D; 81/125; 81/13

[58] Field of Search ..... 81/125, 125.1, 13, 119, 81/456, 457, 458, 3 E, 180 R, 180 D; 294/34

[56] References Cited

U.S. PATENT DOCUMENTS

| | | | |
|---|---|---|---|
| 491,687 | 2/1893 | Quimby | 81/457 |
| 1,159,016 | 11/1915 | Gibson | 81/457 |
| 1,513,406 | 10/1924 | Lipscomb | 81/457 |
| 1,550,436 | 8/1925 | Hall | 81/119 |
| 1,655,168 | 1/1928 | Speckman | 81/125 |
| 1,977,323 | 10/1934 | Morgan | 81/458 |
| 2,369,400 | 2/1945 | Malcom | 81/125.1 |
| 2,557,628 | 6/1951 | Becker | 81/125 |
| 2,697,371 | 12/1954 | Bowman | 81/125.1 |
| 2,960,131 | 11/1960 | Clark | 81/456 |
| 3,730,237 | 5/1973 | Hamzlik | 81/456 |
| 4,058,032 | 11/1977 | Jacks | 81/125 |

*Primary Examiner*—Roscoe V. Parker
*Attorney, Agent, or Firm*—Trask & Britt

[57] ABSTRACT

A nut-holding attachment for an open-end wrench with fixed jaws is disclosed. This attachment has fingers at one end which are adapted to curve around the end of the wrench whereby to present a surface adjacent each face of the wrench in order to hold a nut between the jaws of the wrench . The attachment is adapted to slide along the handle or shank of the wrench so that the fingers may be drawn over the end of the wrench to a nut-engaging position or slid away from the end to a non-engaging position.

8 Claims, 7 Drawing Figures

NUT-HOLDER ATTACHMENT FOR OPEN-END WRENCH

BACKGROUND OF THE INVENTION

1. Field

This invention relates to nut-holding and bolt-holding attachments for open-end wrenches. The term "nut-holding" is used in this application to include "bolt-holding" inasmuch as the size and shape of the head of a bolt is similar to that of a nut.

2. Prior Art

A wide variety of nut-holding attachments for open-end wrenches have been described in the patent literature.

U.S. Pat. No. 4,058,032 of Jacks describes a resilient clip which fits within the jaws of an open-end wrench. Most of the patents known to inventor, however, involve a flap or plate which slides over the jaws of an open-end wrench.

Attachments of this latter type are illustrated in U.S. Pat. Nos. 1,655,168 to Speckman; 2,557,628 of Becker; 2,697,371 of Bowman; and 2,369,400 of Malcom. These devices are essentially flat or planar in nature whereby a flap or plate member is slid along one face of the jaws of a wrench to cover partially the slotted opening formed by the jaws. Another patent, U.S. Pat. No. 1,550,436 of Hall, discloses a somewhat similarly shaped wrench attachment wherein the nut engaging portion is displaced from the face of the wrench. The Hall device is intended to prevent the wrench from falling off a nut or bolt during tightening.

OBJECTS OF THE INVENTION

It is an object of the instant invention to provide a nut-holding attachment for an open-end wrench which securely holds a nut between the jaws of the wrench regardless of the orientation of the wrench.

Another objective of the instant invention is to provide a device which may easily be attached or removed from an open-end wrench.

A further object is to provide a nut-holding attachment which permits easy removal of the wrench once a bolt has been tightened.

A still further object is to provide a nut-holding attachment which permits the wrench to be easily placed on a nut to be removed from a bolt.

DESCRIPTION OF THE INVENTION

A unique nut-holding attachment for an open-end wrench has been invented. The nut-holding attachment comprises an elongated, narrow, rigid strip or web having a length substantially less than the wrench to which the attachment unit is intended to attach and a cuff at one terminus of the rigid strip for attachment to the wrench. The cuff may be of a different material and may completely envelop or enclose a portion of the shank of the wrench to form a sleeve. A further understanding of the invention may be facilitated by reference to the attached drawings.

Figure 1:
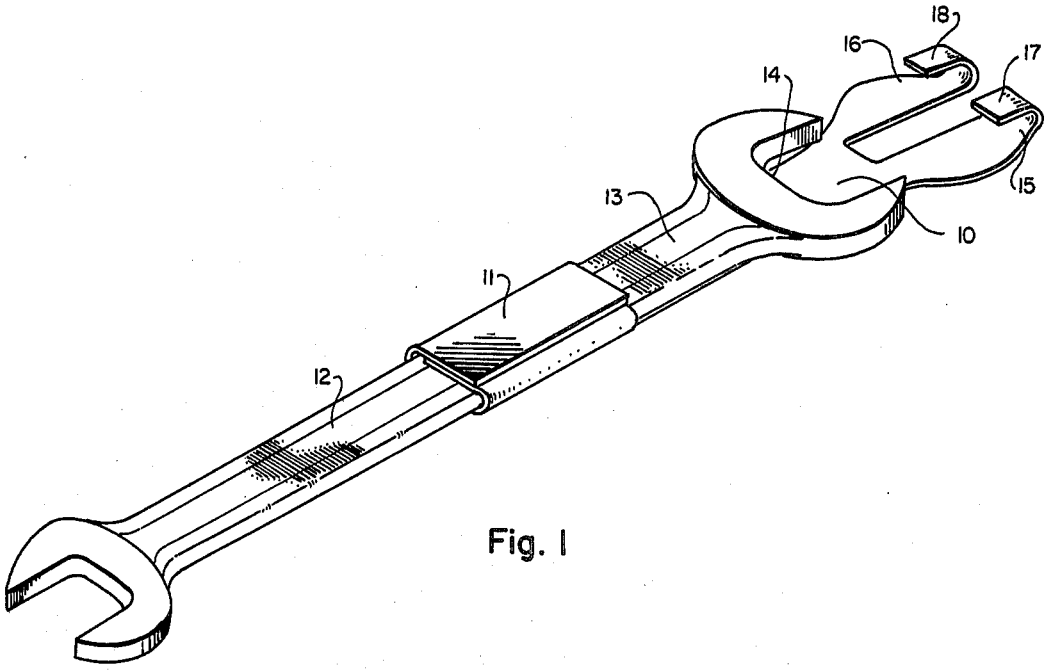
FIG. 1 is a perspective view of a nut-holding device of this invention.

FIG. 1 is a perspective view of an open-end wrench with the nut-holding attachment affixed thereto in a sliding relationship. The nut-holding attachment 10 has a cuff 11 which at least partially wraps around the shank 12 of the wrench 13. The cuff 11 preferably has sufficient length that it holds the attachment in proper alignment with the wrench. However, for a cuff intended to slide along the shank of a wrench, it must not be the same length as the shank of the wrench (the shank being a narrow handle between the two heads of the wrench) or else it will have no room to slide along the handle. Generally, the cuff or sleeve slides a distance which is about equivalent to the length of the slot 14 (jaw opening of the wrench) to ensure that the free ends of the curved fingers of the nut-engaging portion of the wrench are clear of the end of the wrench.

The nut-holding attachment 10 has fingers 15 and 16 which are generally identical in length and shape. Fingers 15 and 16 curve about the end of the wrench and have tab portions 17 and 18 which overlap the end of the wrench so that the fingers are adjacent opposite faces of the wrench. The nut-holding attachment preferably lies substantially flat against a wrench to which it attaches. The distance between the tab portions 17 and 18 of the fingers and opposed flat portions of fingers 15 and 16 is approximately the thickness of the head of the wrench.

Figure 2:
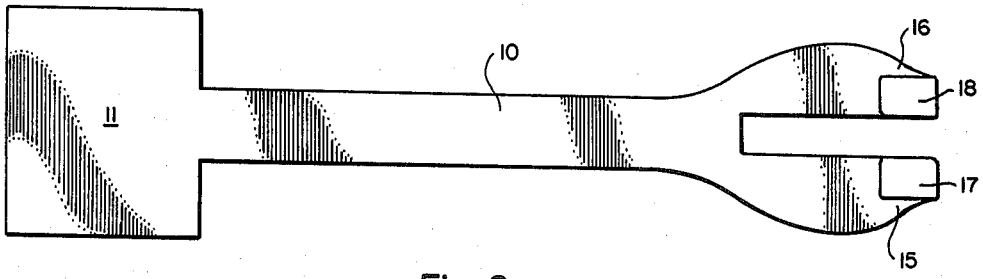
FIG. 2 is a plan view of a cut-out of the nut-holding device illustrated in FIG. 1.

The nut attachment holder may be made out of thin metal or other appropriate materials indicated herein. FIG. 2 illustrates a metal strip with the cuff 11 in a flat position. The tabs 17 and 18 are indicated in a folded position with dotted lines showing the tabs in their original flat position. The cuff 11 may be folded about the shank of the wrench, as illustrated in FIG. 1.

Figure 3:
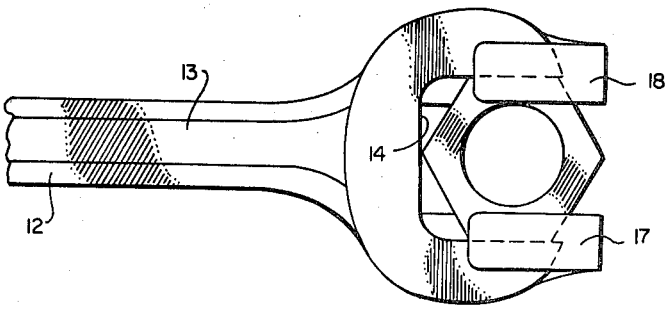
FIG. 3 is a plan view of one face of the device of FIG. 1 showing a nut in position between the jaws of a wrench.
Figure 4:
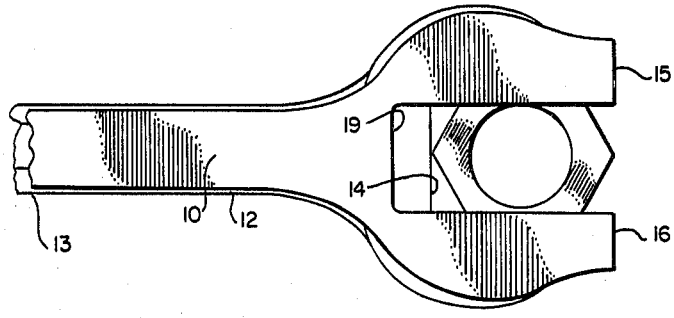
FIG. 4 is a reverse plan view of the illustration of FIG. 3.

The functioning of the nut-holding attachment is illustrated in FIGS. 3 and 4. The tabs 17 and 18, when slid over the end of the wrench, hold a nut in position in the slot 14 of ridge 13. Tabs 17 and 18 hold the nut from falling out one side of the wrench (see FIG. 3) while the fingers 15 and 16 permit the nut from falling out the other side of the wrench (see FIG. 4). The slot 19 formed by fingers 15 and 16 must be sufficiently wide to allow a bolt to pass therethrough to engage the nut.

Figure 5:
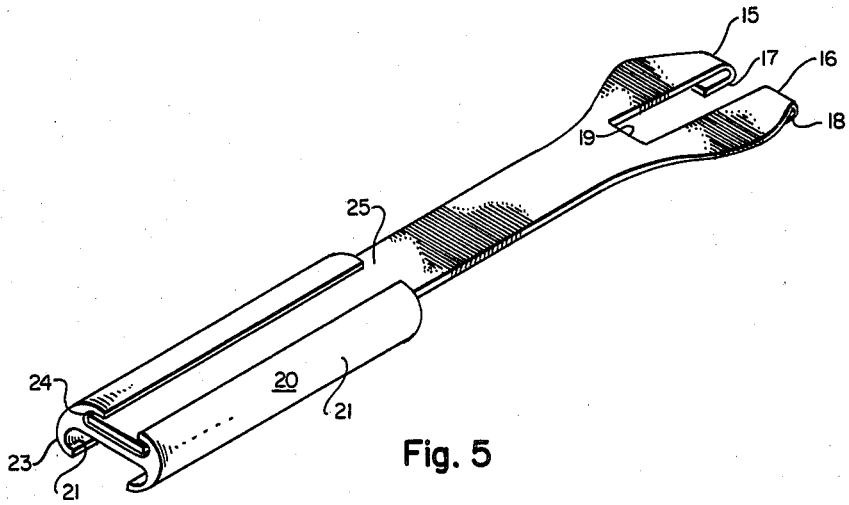
FIG. 5 is a perspective view of a clip-on nut-holding device having a clip-type handle.

A variation on the nut-holding attachment is illustrated in FIG. 5 wherein the "cuff" is a handle grip made out of plastic or other material which is sufficiently resilient to permit it to be clamped upon the shank of a wrench. The handle grip 20 is preferably of sufficient length to be secure on the handle when it is clamped upon the shank of the wrench. In this instance, the handle grip may be as long as the shank of the wrench inasmuch as it is structured so that the arm of the nut-holding attachment slides within the handle grip. The handle grip has a large slot 21 which is sized to fit about the shank of a wrench and fit relatively securely so that there is a minimum of wobble or movement between the handle grip 20 and the wrench. The sidewalls 22 and 23 of the handle grip should be sufficiently resilient to bend while the grip is being inserted about the wrench and then spring back into position to maintain the proper slot configuration. A second slot 24 exists in the upper portion of the handle grip whereby said slot is sized to receive the arm 25 of a nut attachment. Slot 24 is sized to fit relatively snugly about the arm 25, yet permits the arm to be slid forward and backward in the slot.

The instant invention is particularly useful inasmuch as a common or standard open-end wrench can be fitted or retrofitted with a nut-holding attachment. The wrench can then be used as an extension to reach a remote place to start a nut on a bolt or to loosen and retrieve a nut from a hard to reach location, i.e., where the space is too small or tight to permit a workman's hand access. The attachment also permits the wrench to be used with X-head screws and the like.

A nut holder attachment, such as that illustrated in FIG. 5, is particularly useful inasmuch as a single nut holder attachment could be used for wrenches of several sizes. The handle grip portion could be clipped onto one wrench as it is needed and then removed and clipped onto another wrench. The width and depth of the slot of the yoke portion of the nut-holding attachment could be sized so that it could be used in conjunction with several wrenches of closely-related sizes. For example, the same size slot could be used in conjunction with a one-half inch wrench, as well as with a 9/16 inch and a $\frac{5}{8}$ inch wrench. The shanks of such wrenches would be about the same size. However, a different size nut-holding attachment would generally be required to accommodate both a $\frac{1}{2}$ inch wrench and a one inch wrench, for example. However by having only a few nut-holding attachments, a whole range of wrenches could be retrofit from $\frac{1}{4}$ inch to one inch or greater using the type of device illustrated in FIG. 5.

The device illustrated in FIG. 1, by contrast, would be normally fit or retrofit on a particular wrench and would not be removed therefrom regularly for use on another wrench.

The nut-holding attachment may be relatively lightweight and made of thin sheet metal or other lightweight materials inasmuch as the nut-holding attachment does not have to resist any significant degree of force.

Figure 6:
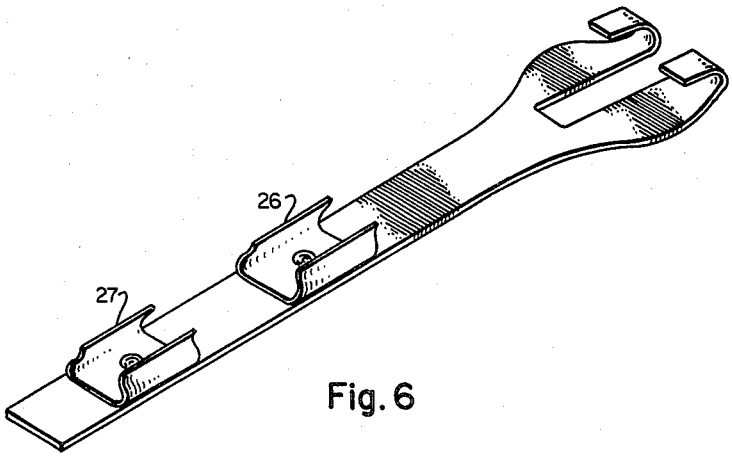
FIG. 6 is a perspective view of a simplified clip-on nut-holding attachment.

FIG. 6 is a perspective view of a nut-holding attachment. A pair of spring metal clips 26 and 27 are attached to the narrow strip of the nut-holding attachment 10. The clips are preferably spaced slightly apart so that the nut-holding attachment does not wobble when snapped on the shank or handle of an open-end wrench. By proper sizing of clips 26 and 27, a single nut-holding attachment could fit a pair of open-end wrenches of adjacent sizes.

Figure 7:
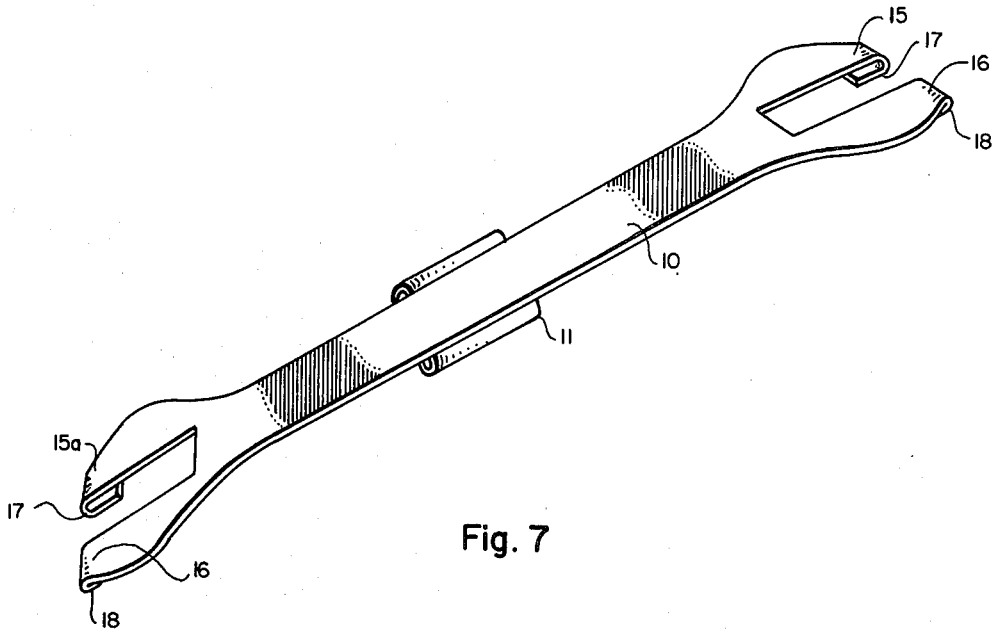
FIG. 7 is a double-ended nut-holding attachment for double-open-end wrenches.

The nut-holding attachment of FIG. 7 has dual heads to fit an open-end wrench which has an open jaw on each end. The cuff 11*a* is similar to the cuff illustrated in FIG. 1 except that it is preferably centrally located on the device of FIG. 7. The length of the device of FIG. 7 must be sized to fit a double-headed open-end wrench by being sufficiently longer than the wrench to permit the clearance of tabs 17 and 18 beyond the end of one end of the wrench before the curved portion of tabs 17*a* and 18*a* contacted the other end of the wrench.

I claim:

1. A nut-holding attachment for an open-end wrench comprising:

an elongated, narrow, rigid strip having a length substantially less than the wrench to which the attachment unit is intended to attach;

a cuff at one terminus of the rigid strip, said cuff comprising wrap-around members sized to envelop a portion of the shank of a wrench to which the attachment unit is intended to attach, said cuff adapted to serve as a guide to enable the attachment to be slid to and fro along the shank of the wrench;

a nut-holding yoke at the opposite terminus of the strip from said cuff, said yoke comprising a pair of curved fingers, said fingers having a slot therebetween and curved near their ends to enable said fingers to encompass the end of the wrench, said slot having a width slightly less than that of a nut typically held by the jaws of said wrench.

2. The nut-holding attachment of claim 1 wherein said narrow, rigid strip has a width which approximates the width of the shank of said wrench.

3. The nut-holding attachment of claim 1 wherein said cuff has a length which is at least one-fourth the length of the shank of said wrench.

4. The nut-holding attachment of claim 1 wherein the curved fingers of said yoke are sufficiently long that the free ends thereof sufficiently overlap the jaws of said wrench to enable a nut to be held in said jaws when the curved portions of said fingers abut the ends of said jaws.

5. The nut-holding attachment of claim 1 wherein the slot in said yoke is substantially coextensive with the length of the jaw opening of said wrench when said attachment is positioned sufficiently forward that the free ends of said fingers do not substantially overlap the ends of said jaws.

6. The nut-holding attachment of claim 1 wherein the slot in said yoke is slightly wider than the diameter of the threaded stub of a bolt typically held by the jaws of said wrench.

7. The nut-holding attachment of claim 1 wherein the cuff and rigid strip are adapted for positioning relative to the shank of said wrench such that the slot of said yoke is in substantial register with the jaw opening of said wrench when said attachment is in a retracted position.

8. A nut-holding attachment for open-end wrenches comprising:

an elongated narrow strip having a length substantially less than the length of the wrench to which the unit is to attach;

a grip (or handle) member which fits about the shank of a wrench and contains a groove into which the strip slideably engages;

a nut-holding yoke at one end of the strip, said yoke comprising a pair of curved fingers which have a slot therebetween and are curved near their ends to enable said fingers to overlap the end of the wrench and wherein said slot between said fingers is slightly narrower than the slot in the nut-engaging opening of the open-end wrench.

* * * * *